US009071012B1

(12) United States Patent
Emery

(10) Patent No.: US 9,071,012 B1
(45) Date of Patent: Jun. 30, 2015

(54) COAXIAL CABLE CONNECTOR

(71) Applicant: ProComm, Inc., Onarga, IL (US)

(72) Inventor: William M. Emery, Onarga, IL (US)

(73) Assignee: ProComm, Inc. of Hoopeston, Illinois, Onarga, IL (US)

( * ) Notice: Subject to any disclaimer, the term of this patent is extended or adjusted under 35 U.S.C. 154(b) by 56 days.

(21) Appl. No.: 14/093,397

(22) Filed: Nov. 29, 2013

Related U.S. Application Data

(60) Provisional application No. 61/730,960, filed on Nov. 29, 2012.

(51) Int. Cl.
*H01R 9/05* (2006.01)
*H01R 13/622* (2006.01)

(52) U.S. Cl.
CPC ..... *H01R 13/622* (2013.01)

(58) Field of Classification Search
USPC ..... 439/578, 583, 584, 322
See application file for complete search history.

(56) References Cited

U.S. PATENT DOCUMENTS

| | | | | | |
|---|---|---|---|---|---|
| 3,611,271 | A * | 10/1971 | Knapp | ..... | 439/583 |
| 4,138,182 | A * | 2/1979 | Muratsuka | ..... | 439/322 |
| 4,456,323 | A * | 6/1984 | Pitcher et al. | ..... | 439/584 |
| 5,052,946 | A * | 10/1991 | Homolka | ..... | 439/584 |
| 8,568,166 | B2 * | 10/2013 | Ryu et al. | ..... | 439/578 |
| 8,926,362 | B2 * | 1/2015 | Xu et al. | ..... | 439/583 |

* cited by examiner

*Primary Examiner* — Neil Abrams
(74) *Attorney, Agent, or Firm* — Singleton Law Firm, P.C.

(57) ABSTRACT

Embodiments of the present invention provide a coaxial cable connector. A coaxial cable connector in accordance with an embodiment of the present invention provides a connector member which is soldered to a coaxial cable to provide an electrical interface for the coaxial cable, and a mating shell having an electrically insulating shell which protects the connector member. The insulating shell is threadably mateable over an externally threaded portion of the connector member, and an internally threaded portion of an outer shell is threadably mateable over the insulating shell.

7 Claims, 5 Drawing Sheets

COAXIAL CABLE CONNECTOR

CROSS-REFERENCE TO RELATED APPLICATIONS

The present application claims the benefit of U.S. Provisional Patent Application No. 61/730,960, filed Nov. 29, 2012, which is hereby incorporated by reference in its entirety.

BACKGROUND OF THE INVENTION

Coaxial RF connectors provide electrical connections between coaxial cables transmitting electrical signals having frequencies in the multi-megahertz range. Many standard types of RF connectors are known, adapted for various categories of coaxial cables with frequencies co-opted for different functions. One known RF connector is the UHF connector, commonly implemented by providing a cable plug of a particular design, known as the PL-259 plug.

The PL-259 plug, in use, is soldered to a coaxial cable in order to provide an electrical interface which may be inserted into a corresponding socket. A coaxial cable is stripped to expose a center conductor wire. The PL-259 plug provides a body which receives the coaxial cable, housing a pin which receives the center conductor. The body of a PL-259 plug accepts a coaxial cable having a diameter of 0.405 inches, such as an RG-213 cable or an RG-8 cable. Soldering of the PL-259 plug to the coaxial cable establishes an electrical connection between the center conductor and the connector pin.

The PL-259 plug is protected by an outer shell. The body of the PL-259 plug retains the outer shell and prevents the outer shell from slipping off a PL-259 plug which has been soldered to the coaxial cable. However, the outer shell must be set onto the coaxial cable before the plug is soldered to the coaxial cable, as the retention mechanism prevents the outer shell from being sheathed onto a plug which has been soldered to a coaxial cable.

In use with narrower coaxial cables, such as an RG-8X cable having a diameter of 0.24 inches, the PL-259 plug cannot be soldered directly to the cable. A reducer is soldered to the coaxial cable to adapt the diameter of the coaxial cable to be receivable by the body. The reducer provides an adapter which inserts into the body to create an electrical connection. By adding an additional mechanical element to the electrical connection, the use of reducers contributes to impedance and loss of electrical signal in the electrical interface provided by the PL-259 plug.

BRIEF SUMMARY OF THE INVENTION

Embodiments of the present invention provide a coaxial cable connector. A coaxial cable connector in accordance with an embodiment of the present invention provides a connector member and a mating shell.

A connector member in accordance with an embodiment of the present invention provides a conductor pin and a conductor body. A mating shell in accordance with an embodiment of the present invention provides an insulating shell having an inner wall lined with an insulating gasket, and an outer shell.

The outer shell and the outer wall of the insulating shell are mateably threaded such that the insulating shell is threadable through the outer shell. The outer shell and the insulating shell are threadably engageable such that the outer shell sheaths the insulating shell.

The conductor body and the inner wall of the insulating shell are mateably threaded such that the conductor body is threadable through the insulating shell, extruding the conductor pin through the insulating gasket of the insulating shell. The connector member and the insulating shell are threadably engageable such that a length of the conductor pin extends beyond a first end of the insulating shell, and a length of the conductor body extends beyond a second end of the insulating shell.

Soldered connections are formed between a coaxial cable and the connector member to form an electrical connection between the central conductor wire of the coaxial cable and the connector member. The coaxial cable has a central conductor wire and a braid. The central conductor wire is inserted through the connector pin and soldered to the connector pin. The braid is inserted through the conductor body and soldered to the conductor body. The connector member may be threadably engaged to the mating shell after soldered connections are formed between the coaxial cable and the connector member.

DETAILED DESCRIPTION OF THE INVENTION

Embodiments of the present invention provide a coaxial cable connector. A coaxial cable connector in accordance with an embodiment of the present invention provides a connector member and a mating shell.

Figure 1A:
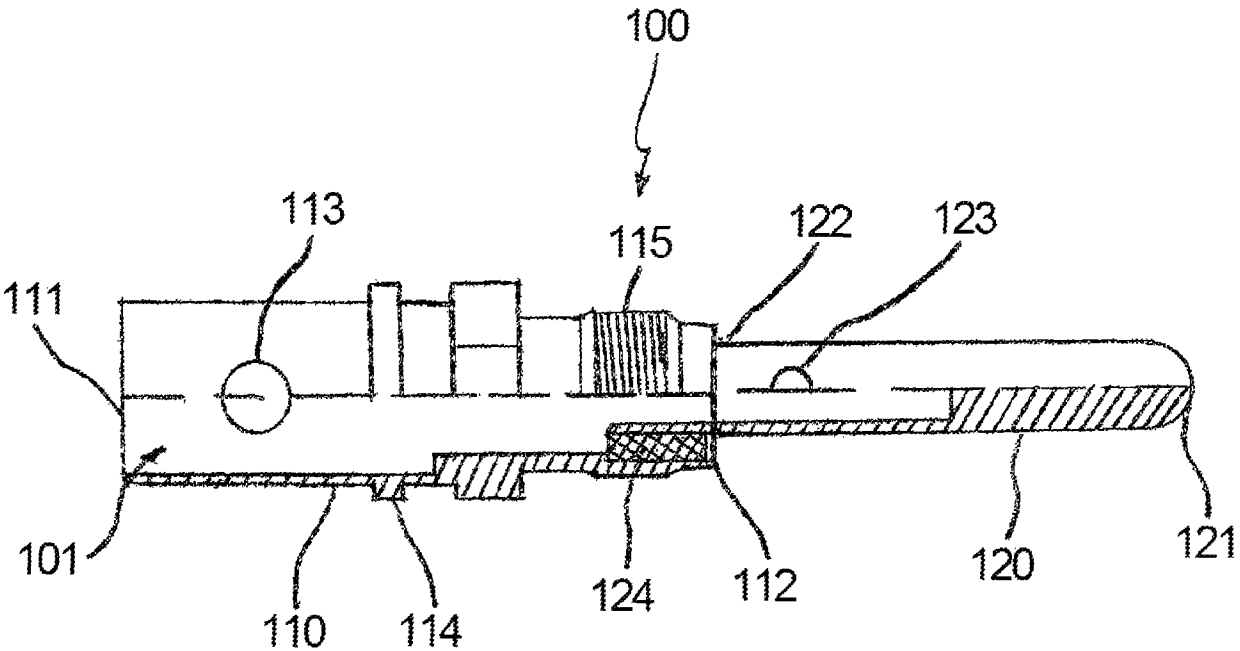
FIGS. 1A and 1B illustrate views of a connector member of a coaxial cable connector.

FIG. 1A illustrates a profile view of a connector member 100 of a coaxial cable connector in accordance with an embodiment of the present invention. A connector member 100 has a hollowed and substantially cylindrical connector interior space 101 formed from a conductor body 110 and a conductor pin 120, both substantially cylindrical and formed from an electrically conductive material. In embodiments of the present invention, the electrically conductive material is brass.

Figure 1B:
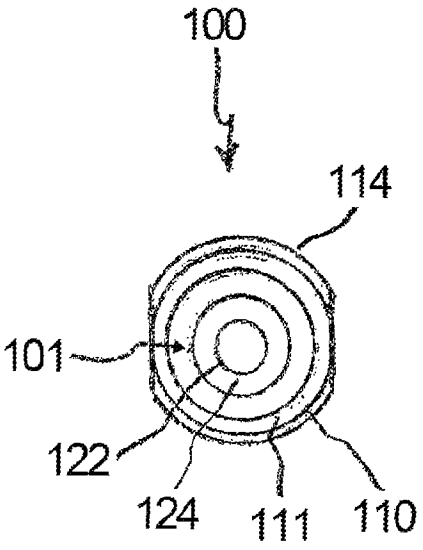

The conductor body 110 is open at a receiving end 111 and is open at a threaded end 112, and is further open through an outer solder receptacle 113 of a wall of the conductor body 110. FIG. 1B illustrates a cross-section view of the connector member 100 from the receiving end 111. The receiving end 111 has a greater diameter than the threaded end 112. In embodiments of the present invention, the receiving end 111 has an outer diameter of 8.4 mm at its opening. In embodiments of the present invention, the conductor body 110 has an outermost diameter of 9.5 mm at a point 114 between the receiving end 111 and the threaded end 112. The threaded end 112 of the conductor body 110 has an external circumferential thread 115.

The conductor pin 120 has a closed tip 121 and an open base 122, and is further open through an inner solder receptacle 123 of a wall of the conductor pin 120. The conductor body 110 and the conductor pin 120 are joined at the threaded end 112 of the conductor body 110 and at the open base 122 of the conductor pin 120, where a length of the open base 122 is inserted through the threaded end 112. The difference between the inner diameter of the conductor body 110 and the outer diameter of the conductor pin 120 forms an annular space, which is sealed by an insulating gasket 124 between the open base 122 and the threaded end 112. In embodiments of the present invention, the insulating gasket 124 is formed from a dielectric material such as Bakelite, and provides electrical insulation between the conductor body 110 and the conductor pin 120.

The interior space 101 of the connector member 100 runs through the conductor body 110 to the threaded end 112 of the conductor body 110. The interior space 101 of the connector member 100 is narrowed at the join between the conductor body 110 and the conductor pin 120. The interior space 101 of the connector member 100 further runs from the open base 122 of the conductor pin 120 to the closed tip 121 of the conductor pin 120. The interior space 101 of the connector member 100 is accessible through the receiving end 111 of the conductor body 110, through the outer solder receptacle 113, and through the inner solder receptacle 123.

Figure 2C:
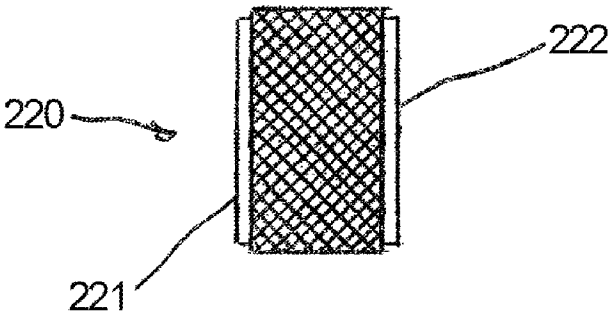
FIGS. 2A through 2D illustrate profile views of a mating shell of a coaxial cable connector.
Figure 2D:
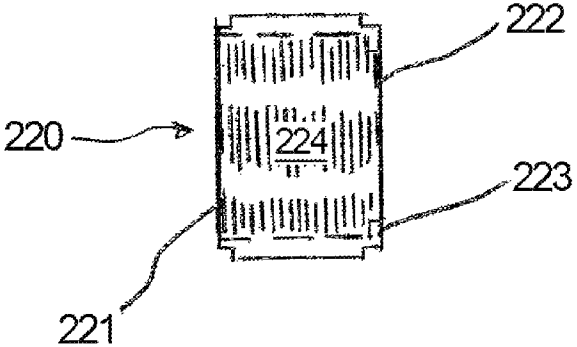
Figure 2A:
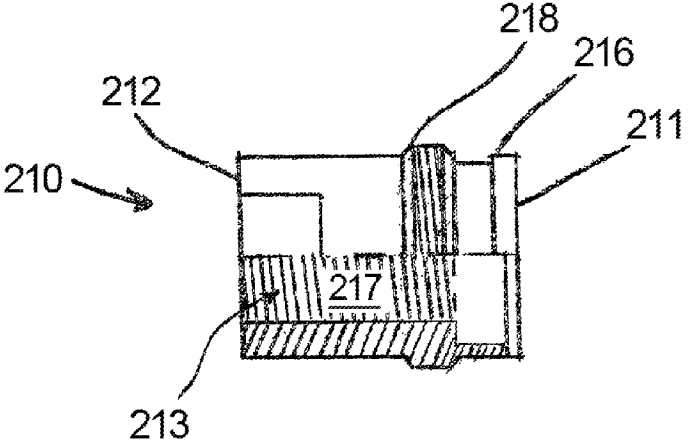
Figure 2B:
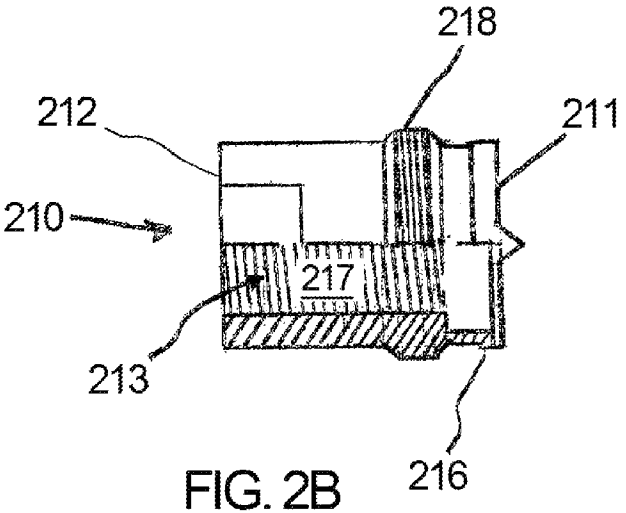

FIGS. 2A through 2D illustrate profile views of an insulating shell 210, illustrated by FIGS. 2A and 2B, and an outer shell 220, illustrated by FIGS. 2C and 2D, of a mating shell 200 of a coaxial cable connector in accordance with an embodiment of the present invention. The insulating shell 210 is open at a pin end 211 and is open at a cable end 212. The insulating shell 210 has a substantially cylindrical shell interior space 213, formed by the inner wall of the insulating shell 210. An inner insulating gasket 214 having an inner opening 215 (not visible in profile view) is fitted at the pin end 211 of the insulating shell 210, narrowing the pin end 211 opening of the insulating shell 210 to the diameter of the inner opening 215 of the inner insulating gasket 214. The circumference of the pin end 211 opening of the insulating shell 210 is encircled by a connector ring 216 which widens the outer diameter of the insulating shell 210 at the pin end 211 opening. In embodiments of the present invention, the outer diameter of the insulating shell 210 at the pin end 211 opening is 14 mm. The shell interior space 213 is accessible through the inner opening 215 of the inner insulating gasket 214, and is accessible through the cable end 212 of the insulating shell 210.

The inner wall of the insulating shell 210 has an internal circumferential thread 217 running substantially along the length of the shell interior space 213 from the inner insulating gasket 214 to the cable end 212 of the insulating shell 210. The outer wall of the insulating shell 210 has an external circumferential thread 218 which, in embodiments of the present invention, has a diameter of ⅝ inch.

The outer shell 220 has an outer diameter which, in embodiments of the present invention, is 19 mm. The outer shell 220 is open at a broad end 221 and a narrow end 222. The outer shell 220 has a substantially cylindrical outer shell interior space. At the narrow end 222 of the outer shell 220, a narrowing ring 223 projects inward from the circumference of the opening of the outer shell 220 to narrow the diameter of the narrow end 222 opening. The inner diameter of the narrowing ring 223, in some embodiments of the present invention, is 13.5 mm. The inner wall of the outer shell 220 has an internal circumferential thread 224.

The external circumferential thread 115 of the threaded end 112 of the conductor body 110 and the internal circumferential thread 217 of the insulating shell 210 are threadably mateable. The external circumferential thread 115 of the conductor body 110 and the internal circumferential thread 217 of the insulating shell 210 are placed in contact by inserting the connector member 100 into the insulating shell 210 through the cable end 212 of the insulating shell 210 so as to pass the conductor pin 120 through the inner insulating gasket 214 at the pin end 211 of the insulating shell 210. In embodiments of the present invention, the inner insulating gasket 214 is formed from a dielectric material such as Bakelite, and provides electrical insulation surrounding the conductor pin 120. Threadably mating the external circumferential thread 115 of the conductor body 110 and the internal circumferential thread 217 of the insulating shell 210 pushes a length of the conductor pin 120 through the inner insulating gasket 214, up to a point at which the cable end 212 of the insulating shell 210 meets the receiving end 111 of the conductor body 110. The diameter of the receiving end 111 of the conductor body 110 is greater than the diameter of the opening of the insulating shell 210 at the cable end 212, blocking further threading between the conductor body 110 and the insulating shell 210.

The external circumferential thread 218 of the insulating shell 210 and the internal circumferential thread of the outer shell 220 are threadably mateable. The external circumferential thread 218 of the insulating shell 210 and the internal circumferential thread 224 of the outer shell 220 are placed in contact by sheathing the outer shell 220 over the insulating shell 210 from the broad end 221 of the outer shell 220. In embodiments of the present invention, the internal diameter of the narrowing ring 223 of the outer shell 220 is narrower than the outer diameter of the insulating shell 210 at the pin end 211 opening, and is narrower than the diameter of the external circumferential thread 218 of the insulating shell 210, such that the outer shell 220 cannot be sheathed over the insulating shell 210 in either direction from the narrow end 222 of the outer shell 220.

The external circumferential thread 218 of the insulating shell 210 is shorter in length than the internal circumferential thread 224 of the outer shell 220. The external circumferential thread 218 of the insulating shell 210 and the internal circumferential thread 224 of the outer shell 220, once threadably engaged, may be unthreaded by threading the outer shell 220 either towards the pin end 211 of the insulating shell 210 or towards the cable end 212 of the insulating shell 210. The internal diameter of the narrowing ring 223 of the outer shell 220 is narrower than the diameter of the external circumferential thread 218 of the insulating shell 210, such that when the outer shell 220 is unthreaded towards the pin end 211 of the insulating shell 210, the external circumferential thread 218 of the insulating shell 210 is caught between the narrowing ring 223 and the internal circumferential thread 224, blocking the outer shell 220 from unsheathing from the insulating shell 210 both towards the pin end 211 and towards the cable end 212. Thus, the outer shell 220 is retained in a sheathing configuration over the insulating shell 210.

Figure 3A:
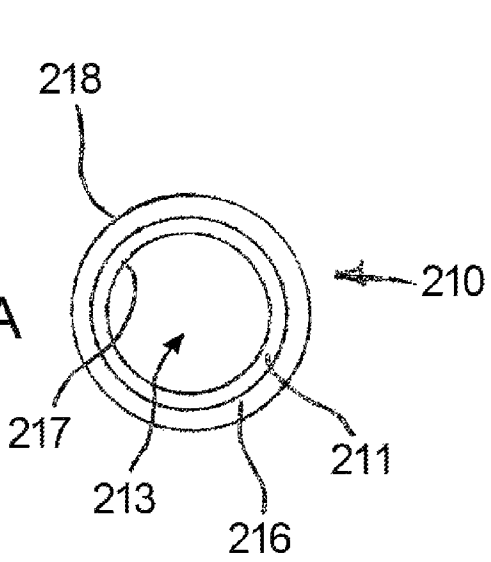
FIGS. 3A through 3D illustrate cross-section views of the mating shell of a coaxial cable connector.
Figure 3B:
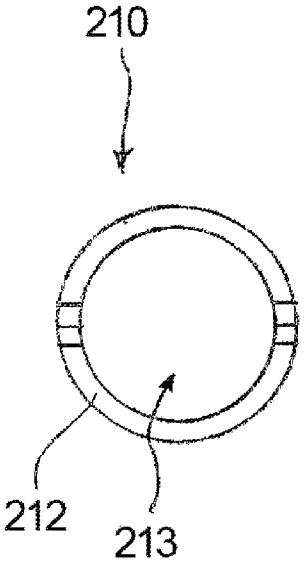
Figure 3C:
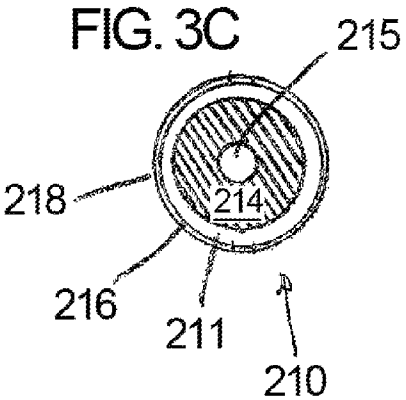
Figure 3D:
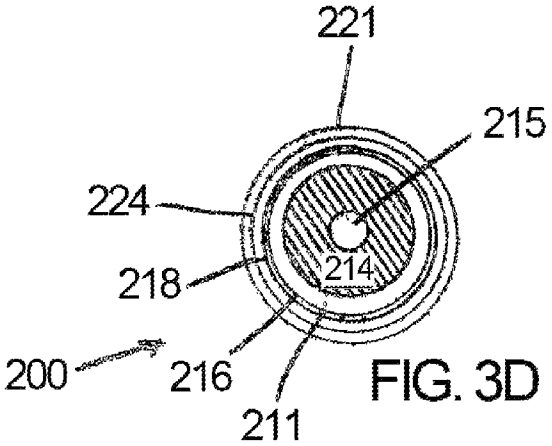

FIGS. 3A through 3D illustrate cross-section views an insulating shell 210 and an outer shell 220 of the mating shell 200 of a coaxial cable connector in accordance with an embodiment of the present invention. FIG. 3A illustrates a cross-section view of the insulating shell 210 from the pin end 211 unobstructed by the insulating gasket 214; FIG. 3B illustrates a cross-section view of the insulating shell 210 from the cable end 212; and FIG. 3C illustrates a cross-section view of the insulating shell 210 from the pin end 211 showing the inner insulating gasket 214. FIG. 3D illustrates a cross-section view of the insulation shell 210 and the outer shell 220 in mating configuration.

Figure 4B:
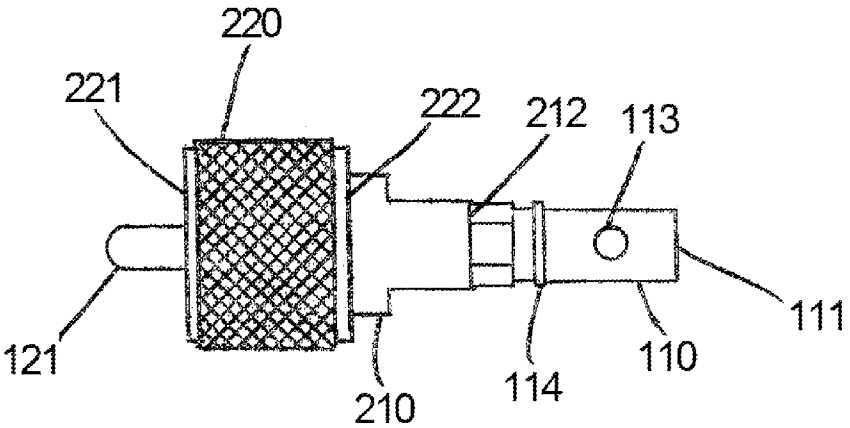
FIGS. 4A and 4B illustrate profile views of the mating shell and the connector member of a coaxial cable connector in threadable engagement.
Figure 4A:
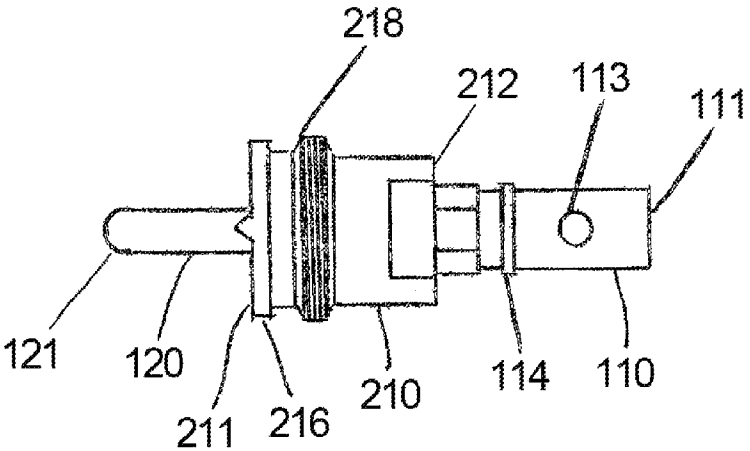

FIGS. 4A and 4B illustrate profile views of the mating shell 200 in threadable engagement with the connector member 100, in accordance with an embodiment of the present invention. FIG. 4A illustrates a profile view of the insulating shell 210 in threadable engagement with the connector member 100. FIG. 4B illustrates a profile view of the outer shell 220 retained in a sheathing configuration over the insulating shell 210 to form the mating shell 200, with the insulating shell 210 in turn in threadable engagement with the connector member 100.

Figure 5:
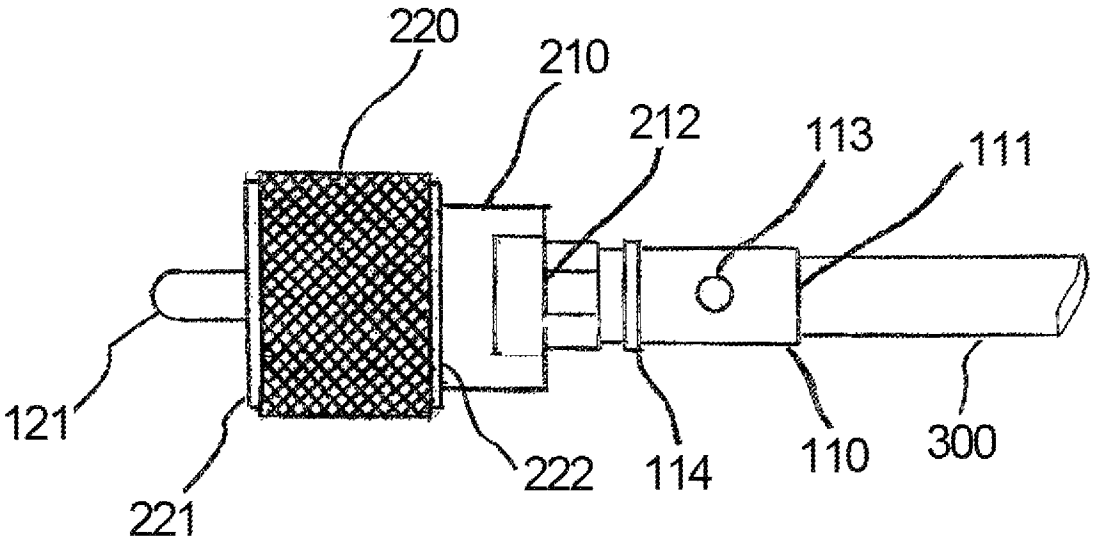
FIG. 5 illustrates a profile view of the connector member of the coaxial cable connector in soldered connection with a coaxial cable.

FIG. 5 illustrates a profile view of the connector member 100 in soldered connection with a coaxial cable 300 in accordance with an embodiment of the present invention. The coaxial cable 300 has a center conductor, an outer conductor, and an outer jacket.

In forming an electrical connection between the coaxial cable 300 and the connector member 100, first, a length of the outer jacket is stripped, and a length of the outer conductor is removed, exposing an exposed length of the outer conductor and an exposed length of the center conductor. The exposed length of the outer conductor is inserted through the receiving end 111 of the conductor body 110, pushing the exposed length of the center conductor into the conductor pin 120 of the connector member 100 through the open base 122 of the conductor pin 120. In embodiments of the present invention, the receiving end 111 of the conductor body 110 has an inner diameter of 6.5 mm, and the coaxial cable 300 is a coaxial cable fitting within this inner diameter.

Next, solder is introduced into the connector member 100 through the outer solder receptacle 113 of the connector member 100, and solder is introduced into the conductor pin 120 through the inner solder receptacle 123 of the conductor pin 120. The exposed length of the grounded braid within the connector member 100 is soldered to the connector member 100. The exposed length of the center conductor within the conductor pin 120 is soldered to the conductor pin 120.

Next, the insulating shell 210 and the outer shell 220 are threadably mated, and the outer shell 220 is then unthreaded from the insulating shell 210 and retained in a sheathing configuration over the insulating shell 210 to form the mating shell 200 as described above. The insulating shell 210 is then threadably mated with the connector member 100 as described above. The outer shell 220, retained in its sheathing configuration, does not impede the threadable mating of the insulating shell 210 with the connector member 100.

The threadably engaged assembly of the connector member 100 and the mating shell 200 provides an electrical interface for the coaxial cable 300 wherein the conductor pin 120 inserts into a receptacle of a socket and the outer shell 220 receives a chassis of the socket. In embodiments of the present invention, the conductor pin 120 has a diameter of 4.0 mm and the inner diameter of the outer shell 220 is ⅝ inch, thus providing an interface for a socket having a receptacle and a chassis mating with these dimensions, such as a SO-239 socket.

Embodiments of the present invention provide a coaxial cable connector providing an electrical connection while requiring minimal mechanical components for soldering to a coaxial cable, thus reducing impedance and power loss when electricity is conducted through the coaxial cable connector.

Embodiments of the present invention further provide a coaxial cable connector having an outer shell which is retained by an insulation shell, the insulation shell being mateable to the connector member of the coaxial cable connector after the connector member has been soldered to a coaxial cable. The outer shell does not impede the mating of the insulation shell to the connector member. Thus, the outer shell may be sheathed onto the connector member after the connector member has been soldered to the coaxial cable. Thus, embodiments of the present invention are not susceptible to errors in the soldering process which impede the assembly of the outer shell with the connector member.

Moreover, the connector member provided by embodiments of the present invention has an outermost diameter of 9.5 mm. Since the outer shell does not need to be assembled with the connector member before the connector member is soldered to the coaxial cable, the connector member provides an electrical interface which is not substantially wider in diameter than a miniaturized coaxial cable, allowing the installation of miniaturized coaxial cables through a variety of small openings.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

What is claimed is:

1. A connector apparatus, comprising:

an insulating member having a first open end and a second open end;

a connector member, the connector member comprising a conductor body and a conductor pin mutually electrically insulated from each other, and an open receiving end opens through the conductor body;

wherein the first open end of the insulating member is fitted with an insulating gasket having an inner opening;

wherein the connector member is threadably engageable within the insulating member such that a length of the connector pin extends through the inner opening of the insulating gasket, and a length of the conductor body, through which the open receiving end, opens extends through the second end of the insulating member.

2. The apparatus of claim 1, wherein a first solder receptacle opens through the conductor pin and a second solder receptacle opens through the conductor body.

3. The apparatus of claim 1, wherein the conductor pin has an outer diameter of approximately 4 millimeters.

4. The apparatus of claim 1, wherein the open receiving end of the conductor body has an inner diameter of approximately 6.5 millimeters and an outer diameter of approximately 8.4 millimeters.

5. The apparatus of claim 1, further comprising an outer shell;

wherein the insulating member and the outer shell are threadably engageable; and wherein the insulating member and the outer shell are threadably disengageable while threadably engaged to retain the outer shell in a sheathing configuration over the insulating shell.

6. The apparatus of claim 5, wherein the outer shell has a first open end, a second open end, and a narrowing ring narrowing the diameter of the second open end of the outer shell;

wherein the insulating member has an outermost diameter along its length;

wherein the outermost diameter of the insulating member is greater than the diameter of the ring of the outer shell.

7. The apparatus of claim 1, further comprising an electrical cable comprising an outer jacket, an outer conductor having a first exposed length, and an exposed center conductor having a second exposed length;

wherein the second exposed length of the exposed center conductor is inserted through the open receiving end into the conductor pin and is soldered to the interior of the conductor pin;

wherein the first exposed length of the outer conductor is inserted through the open receiving end into the conductor body and is soldered to the interior of the conductor body.

* * * * *